US010393487B2

(12) United States Patent
Riess

(10) Patent No.: US 10,393,487 B2
(45) Date of Patent: Aug. 27, 2019

(54) LEAD-FREE PARTIAL FRAGMENTATION BULLET WITH SEPARATION MECHANISM BETWEEN THE REAR OF THE BULLET AND BULLET OGIVE

(71) Applicant: RUAG AMMOTEC GMBH, Fürth (DE)

(72) Inventor: Heinz Riess, Fürth (DE)

(73) Assignee: RUAG AMMOTEC GMBH, Fürth (DE)

( * ) Notice: Subject to any disclaimer, the term of this patent is extended or adjusted under 35 U.S.C. 154(b) by 0 days.

(21) Appl. No.: 15/117,121

(22) PCT Filed: Feb. 10, 2015

(86) PCT No.: PCT/EP2015/052776
§ 371 (c)(1),
(2) Date: May 8, 2017

(87) PCT Pub. No.: WO2015/118172
PCT Pub. Date: Aug. 13, 2015

(65) Prior Publication Data

US 2017/0248395 A1 Aug. 31, 2017

(30) Foreign Application Priority Data

Feb. 10, 2014 (DE) ..... 10 2014 001 611

(51) Int. Cl.
*F42B 12/36* (2006.01)
*F42B 12/06* (2006.01)
*F42B 12/34* (2006.01)

(52) U.S. Cl.
CPC ..... *F42B 12/34* (2013.01); *F42B 12/06* (2013.01); *F42B 12/367* (2013.01)

(58) Field of Classification Search
CPC ..... F42B 12/34; F42B 12/06; F42B 12/367; F42B 12/36; F42B 12/56
(Continued)

(56) References Cited

U.S. PATENT DOCUMENTS 6,546,875 B2 * 4/2003 Vaughn ..... F42B 12/34 102/507
7,543,535 B2 * 6/2009 Herrlinger ..... F42B 12/78 102/514
(Continued)

FOREIGN PATENT DOCUMENTS

AT 406088 B * 2/2000 ..... F42B 12/34
DE 583097 C * 8/1933 ..... F42B 12/34
(Continued)

OTHER PUBLICATIONS

English Translation of DE 19930474 A1; Jan. 2001.*
International Search Report for PCT/EP2015/052776 dated Apr. 15, 2015; English translation submitted herewith (7 Pages).

*Primary Examiner* — James S Bergin
(74) *Attorney, Agent, or Firm* — Fitch, Even, Tabin & Flannery LLP

(57) ABSTRACT

The invention relates to a lead-free partial fragmentation bullet comprising a bullet jacket, a rear core compressed therein, and a nose core compressed in the ogive region, wherein the tip core sits on the rear core. In order that the rear core does not separate from the contacting bullet jacket upon striking a target body and to thereby guarantee a sure exit wound out of the target body, a predetermined breaking point is proposed which is arranged between the rear core and the nose core. The rear core has a molded recess on the end thereof facing the nose core, the end of the nose core facing the tail core fills in said recess, and the bullet jacket
(Continued)

has a peripheral break away edge on the outer circumference in the region of the predetermined breaking point.

6 Claims, 2 Drawing Sheets

(58) Field of Classification Search
USPC ..... 102/507–510
See application file for complete search history.

(56) References Cited

U.S. PATENT DOCUMENTS

| | | | | |
|---|---|---|---|---|
| 7,765,934 | B2 * | 8/2010 | Spatz | F42B 12/34 102/507 |
| 2010/0224093 | A1 * | 9/2010 | Wilhelm | F42B 12/34 102/507 |
| 2017/0261294 | A1 * | 9/2017 | Riess | F42B 5/025 |

FOREIGN PATENT DOCUMENTS

| | | | | |
|---|---|---|---|---|
| DE | 38 02 002 | A1 | 8/1989 | |
| DE | 199 30 474 | A1 | 1/2001 | |
| DE | 199 30 475 | A1 | 1/2001 | |
| DE | 100 42 719 | A1 | 3/2001 | |
| DE | 10042708 | A1 * | 3/2001 | F42B 12/34 |
| EP | 0 225 532 | A1 | 6/1987 | |

* cited by examiner

LEAD-FREE PARTIAL FRAGMENTATION BULLET WITH SEPARATION MECHANISM BETWEEN THE REAR OF THE BULLET AND BULLET OGIVE

CROSS-REFERENCE TO RELATED APPLICATIONS

This application is a U.S. national phase application filed under 35 U.S.C. § 371 of International Application No. PCT/EP2015/052776, filed Feb. 10, 2015, designating the United States, which claims priority from German Patent Application No. 10 2014 001 611.0, filed Feb. 10, 2014, which are hereby incorporated herein by reference in their entirety for all purposes.

BACKGROUND OF THE INVENTION

Field of the Invention

The invention relates to a lead-free partial fragmentation bullet, consisting of a bullet jacket, a rear core pressed into the bullet jacket and a pressed nose core in an ogive region, with the nose core sitting on the rear core.

SUMMARY OF THE INVENTION

The invention is an improvement of lead-free partially fragmenting bullet, providing that when the bullet impacts a target body, a rear core does not detach from an adjacent bullet jacket which provides a more reliable exit wound out of the target body.

Due to a predetermined breaking surface being provided between the rear core and a nose core, the rear core having a recess on an end facing the nose core which fills out an end of the nose core facing the rear core and the bullet jacket having a peripheral tear-away edge on an outside circumference in a region of the predetermined breaking surface, the bullet jacket begins fragmenting in a region of the ogive up to the peripheral tear-away edge and the predetermined breaking surface on impact with a target body. When a sufficient force is applied to the deformed bullet jacket, it is separated from the remainder of the bullet jacket by the peripheral tear-away edge. Then the rear core begins to deform due to the recess and covers the region between the jacket and the core.

The rear core and/or the nose core may also consist of partial cores. The recess is then located in a top rear part.

The recess is preferably a cone. A cone can be introduced without problems and facilitates the fragmentation process.

The break-away edge is located between a beginning and an end of the predetermined breaking surface relative to an axial direction. The tear-away edge delimits the fragmentation process.

A peripheral holding groove is preferably provided on the bullet jacket in a direction of the bullet base beneath the break-away edge. The holding groove causes the bullet jacket and the rear core to hold together until the start of the mushrooming of the rear core.

BRIEF DESCRIPTION OF THE DRAWINGS

The invention is explained in greater detail below in two figures in which.

DETAILED DESCRIPTION OF THE INVENTION

Figure 1:
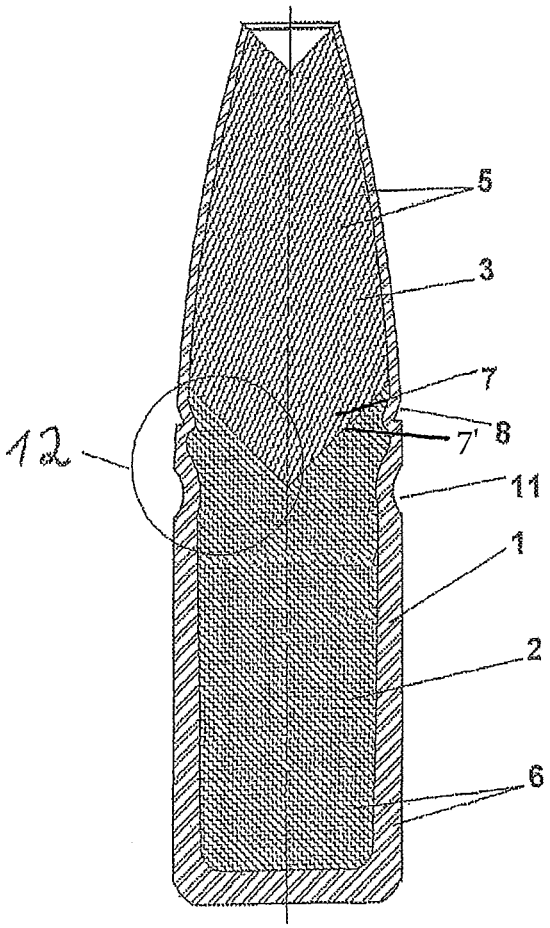
FIG. 1 is a sectional view of an embodiment of a bullet in accordance with the invention prior to impact and FIG. 2 is a view of a bullet in accordance with the invention after impact in which the rear core has separated from the nose core.

FIG. 1 shows an embodiment of a lead-free partial fragmentation bullet according to the invention, consisting of a bullet jacket 1, a rear core 2, a nose core 3 in an ogive region and a separation mechanism 12 located between the nose core 3 and the rear core 2. A predetermined breaking point 7' is located between the rear core and the nose core which is an interface between the cores 3 and 4. The fragmentable part of the bullet, which consists of the nose core 3 and an adjacent bullet jacket, is labeled with reference numeral 5. The remaining non-fragmentable body of the bullet is labeled with reference numeral 6 and consists of the rear core 2 and the adjacent bullet jacket 5.

All readily deformable materials, which preferably are Cu, MS, ST, may be used as the materials of the bullet jacket. All pressable lead-free materials, e.g., Sn and Zn, including granules, or cores permeated with predetermined breaking points, as described in DE 10 2012 023398 A1, are suitable core materials.

The separation mechanism is an interaction between the recess in the rear core which is the same shape as the pressed rear core 2 of the bullet and the break-away edge 8 in the bullet jacket 5.

Figure 2:
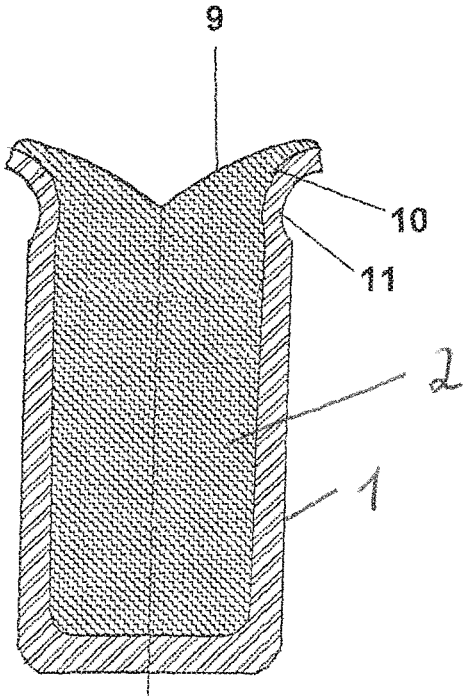

In the rear core 2, the conical recess 7 is pressed into the bullet jacket 1, such that the recess consists of a cone or may be any other shape. It is important that the recess is shaped relative to the axis of the bullet as seen in FIGS. 1 and 2. Next, the nose core 3, which is responsible for the fragmentation, is introduced into the bullet jacket 1 and pressed. The important recess 7, which is formed at the upper end of rear core and faces the lower end of the nose core 3 provides a predetermined break-away surface 7'. After finishing the bullet, a break-away edge 8 is formed circumferentially into the bullet jacket 1. All shapes, which ensure a reliable break-away of the bullet jacket 1 in an area of the break-away edge 8, may be used. The position of the break-away surface 7' is between the end of the nose core 3 and the end of the rear core 2. Only in this way are the function and mechanism of action of the bullet ensured.

As seen in FIG. 1, the bottom end of the nose core 3 sits in the recess 7 of the rear core 2 to completely fill the recess which is a cone. The bottom end of the nose core is complementary to the conical shape of the recess.

Upon impact of the lead-free partial fragmentation bullet with a target body such as a game animal, the bullet jacket 1 and the nose core 3 begin to fragment from the nose core 3 all the way to the break-away edge 8 and the recess 7 in the rear core 2. If the force applied to the deformed bullet jacket is sufficient, the jacket will separate from the rest of the bullet at the break-away edge 8.

Then the recess 7 in the rear core 2 begins to deform, which is identified in FIG. 2 with reference numeral 9 that covers the region 10 between the bullet jacket 1 and the rear core. Depending on the properties of the jacket geometry or jacket material, a holding groove 11 as seen in FIGS. 1 and 2 may be provided beneath the break-away edge 8 which causes the bullet jacket and the rear core to be held together until the start of the mushrooming process shown in FIG. 2 in the rear core. No target medium can penetrate into this region which ensures that the bullet jacket and rear core remain together to form a compact bullet body, which contributes to providing a reliable exit wound from the target body.

If no recess 7 was provided in the rear core 2, the region 10 as seen in FIG. 2 between the bullet jacket 1 and the rear core 2 would not be covered. The target medium would penetrate, the rear core 2 would separate from the bullet jacket and the above mechanism of action of the bullet would no longer be ensured.

The invention claimed is:

1. A lead-free partial fragmentation bullet consisting of a bullet jacket having a peripheral tear-away edge, a rear core pressed into the bullet jacket and a pressed nose core in an ogive region, the nose core sitting on the rear core, a predetermined breaking surface disposed between the rear core and the nose core, the rear core having a recess at an end facing the nose core, the nose core filling the recess of the rear core facing the nose core, and the bullet jacket having the peripheral tear-away edge on an outside circumference thereof in a region of the predetermined breaking surface, a peripheral holding groove for holding the bullet jacket and the rear core together until mushrooming begins which is in the bullet jacket below the peripheral break-away edge, and the peripheral tear-away edge is located beneath a beginning of and above an end of the predetermined breaking surface as viewed in an axial direction.

2. The partial fragmentation bullet according to claim 1, wherein the recess is conical.

3. The partial fragmentation bullet according to claim 2, wherein the nose core completely fills the end of the rear core facing the nose.

4. The partial fragmentation bullet according to claim 1, wherein the bullet jacket axially above the peripheral tear-away edge is thinner than the bullet jacket axially below peripheral break-away edge.

5. The partial fragmentation bullet according to claim 1, wherein the bullet jacket adjacent the nose core is thinner than the bullet jacket adjacent the rear core.

6. The partial fragmentation bullet according to claim 1, wherein a fragmentable part of the bullet consists of the nose core and the adjacent bullet jacket adjacent thereto;

and a remaining part of a non-fragmentable body of the bullet consists of the rear core and the bullet jacket adjacent thereto.

* * * * *